US005676188A

United States Patent [19]

Cadorette

[11] Patent Number: 5,676,188

[45] Date of Patent: Oct. 14, 1997

[54] BLIND CORD SECURITY DEVICE

[75] Inventor: Mario Cadorette, Saint-Therese, Canada

[73] Assignee: All-Teck P.T.B. Inc., 8600 Decarie Blvd., Montreal, Canada

[21] Appl. No.: 668,680

[22] Filed: Jun. 24, 1996

[51] Int. Cl.[6] ..... E06B 9/30

[52] U.S. Cl. ..... 160/178.1 V; 160/320

[58] Field of Search ..... 160/168.1 V, 178.1 V, 160/173 V, 320, 321, 340, 341, 345, 193, 190, 168.1 R, 172 R, 172 V; 16/81, 194, 209, 219, 210, 211, 212, 213, 214

[56] References Cited

U.S. PATENT DOCUMENTS

| | | | |
|---|---|---|---|
| 483,169 | 9/1892 | Schneewind | 16/81 |
| 2,848,045 | 8/1958 | Benett . | |
| 3,022,819 | 2/1962 | Lampret | 160/345 |
| 3,123,130 | 3/1964 | Fridlund . | |
| 3,319,695 | 5/1967 | Houmere . | |
| 3,633,646 | 1/1972 | Zilver . | |
| 4,126,912 | 11/1978 | Johnson | 16/81 |
| 4,271,893 | 6/1981 | McCluskey . | |
| 4,335,776 | 6/1982 | Debs | 160/320 |
| 4,366,852 | 1/1983 | Holzer | 160/320 |
| 4,891,911 | 1/1990 | Yung | 16/81 X |
| 5,125,447 | 6/1992 | Suggs | 160/320 X |
| 5,279,473 | 1/1994 | Rozon . | |

FOREIGN PATENT DOCUMENTS

| | | |
|---|---|---|
| 718703 | 9/1965 | Canada . |

*Primary Examiner*—David M. Purol
*Attorney, Agent, or Firm*—George A. Seaby

[57] ABSTRACT

The looped free ends of venetian or vertical blinds are typically housed in somewhat complicated control or security structures. A simple security device for limiting access to the looped ends of blind cords includes an elongated, rectangular housing for mounting at one end of a blind assembly, at least one counterweight slidably mounted in the housing for vertical movement therein, and a recess in the counterweight for receiving the looped bottom end of a blind cord, so that the end of the cord remains in the housing.

5 Claims, 2 Drawing Sheets

BLIND CORD SECURITY DEVICE

BACKGROUND OF THE INVENTION

1. Field of the Invention

This invention relates to a blind cord security device.

More specifically, the invention relates to a device for protecting the normally looped free end of a blind cord, limiting access to such free end.

2. Discussion of the Prior Art

The looped bottom ends of venetian or vertical blind cords can constitute a safety hazard, particularly for small children. Such blind cords often hang down to a short distance above the floor, and consequently are readily accessible to small children. If a child places the looped bottom end of a blind cord around his or her neck, the result may be injury or strangulation. Moreover, since everything goes in the mouth, a child can choke on a blind cord.

Many solutions to the problem outlined above have been proposed. Examples of the proposed solutions are found in Canadian patent No. 718,703, issued to F. Vecchiarelli et al on Sep. 28, 1965, and U.S. Pat. Nos. 2,848,045, issued to D. L. Bennett on Aug. 19, 1958; 3,123,130, issued to O. Fridlund on Mar. 3, 1964; U.S. Pat. No. 3,319,695, issued to W. Houmere on May 16, 1967; 3,663,646, issued to E. Zilver on Jan. 11, 1972; 4,271,893, issued to W. A. McCluskey on Jun. 9, 1981 and 5,279,473, issued to D. Rozon on Jan. 18, 1994. While some of the patented devices were not proposed as security or safety devices, they could be used for such purpose and accordingly are listed herein.

In general, the patented and other blind cord security devices are somewhat complicated in mechanical terms, including hardware such as gears and springs. Consequently the devices are expensive and often difficult to install and/or to maintain. Accordingly, a need still exists for an inexpensive blind-cord security device, which is easy to install and maintain.

GENERAL DESCRIPTION OF THE INVENTION

The object of the present invention is to meet the above defined need by providing a relatively simple blind cord security device, which has few moving parts, and which does not require any special skills or equipment to install.

Accordingly, the present invention relates to a blind cord protector device comprising elongated housing means for mounting vertically at one end of a blind; passage means extending longitudinally of said housing means for receiving a looped bottom end of a blind cord; counterweight means in said passage means for mounting on the looped bottom end of the blind cord and for maintaining the cord under tension; and stop means for preventing unauthorized removal of the bottom end of the cord and the counterweight means from said passage means.

BRIEF DESCRIPTION OF THE DRAWINGS

The invention is described below in greater detail with reference to the accompanying drawings, which illustrate a preferred embodiment of the invention, and wherein.

DESCRIPTION OF THE PREFERRED EMBODIMENT

It will be noted that the following detailed description relates to a device for use with a dual cord vertical blind. Of course, the device of the present invention can be used with any blind controlled by a cord or cords.

Figure 1:
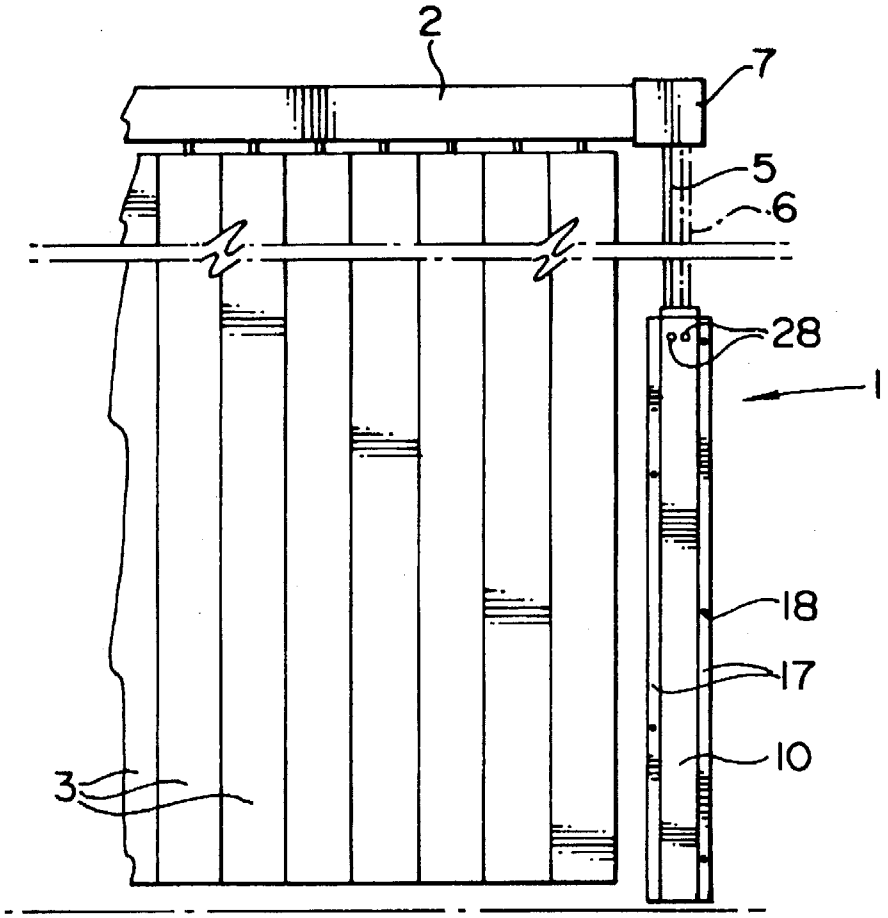
FIG. 1 is a schematic front view of one end of a vertical blind assembly incorporating a blind cord security device in accordance with the present invention.
Figure 3:
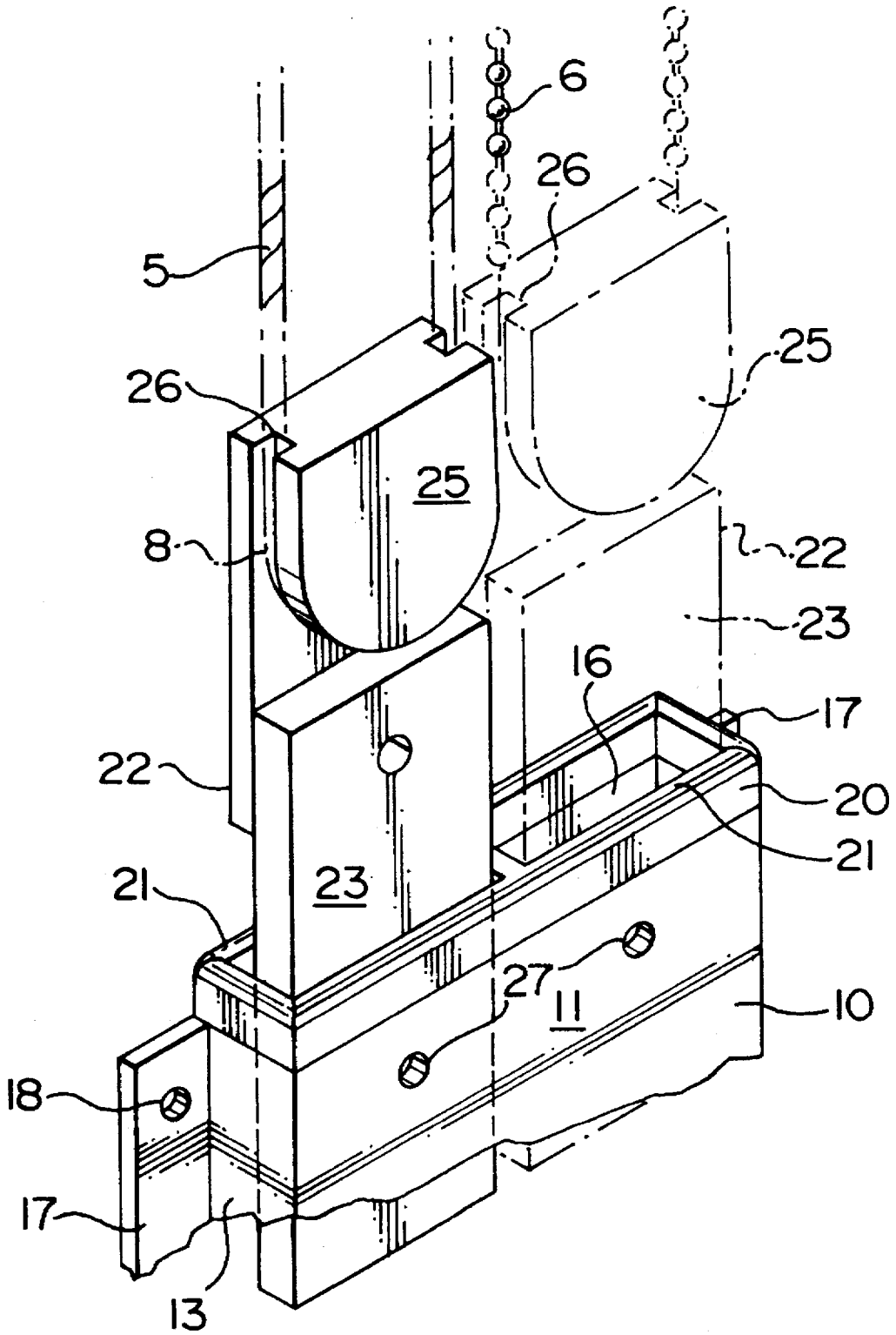
FIG. 3 is a partially exploded, isometric view of the top end of the blind cord security device of FIGS. 1 and 2.

Referring to FIG. 1, the blind cord security device of the present invention which is generally indicated at 1 is intended for use with a blind, for example the vertical blind illustrated in FIG. 1. The blind includes a top track casing 2 and a plurality of vertical louvers 3 suspended from a control assembly (not shown) in the casing 2. Operation of the control assembly and consequently movement of the louvers 3 is effected using a cord 5 and a chain 6 (hereinafter referred to collectively as cords) extending downwardly from one end 7 of the casing 2. The loops 8 (one shown in FIG. 3) at the bottom ends of the cord 5 and the chain 6 are retained in or protected by the device 1 of the present invention.

The device 1 includes an elongated housing 10 of rectangular cross section which is defined by a front wall 11 and a rear wall 12 joined by side walls 13. A vertical partition 14 extends between the front and rear walls 11 and 12, respectively. The partition 14 divides the interior of the housing 10 into two elongated, rectangular cross section passages 16. The side edges of the rear wall 12 extend outwardly beyond the side walls 13, defining flanges 17 with holes 18 (FIGS. 3 and 3) for mounting the housing on a wall or other structure beside the blind. Preferably the housing 10 extends at least four and one-half feet from the floor limit access to the cord 5 and the chain 6 to tall (older) children and adults. A rectangular cover 20 having the same configuration as the open top end of the housing 10 is mounted on the housing. The cover 20 has rounded top edges 21 for protecting the user.

Figure 2:
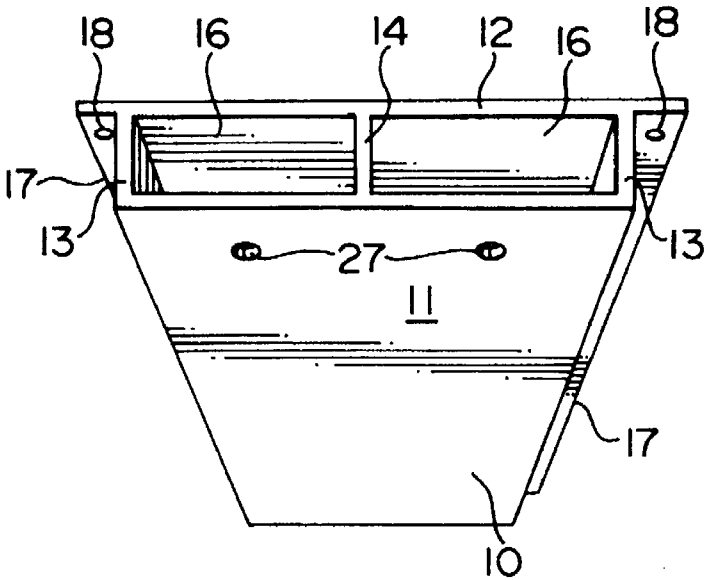
FIG. 2 is a perspective view from above of a housing used with the blind cord security device of FIG. 1.

A counterweight 22 is slidably mounted in each of the passages 16. Each counterweight 22 includes a body defined by an elongated metal plate 23 and a second plate 25. The plate 23 acts as a weight to bias the counterweight downwardly. The plate 25 is connected to the top end of the body 23, and includes a generally U-shaped recess 26 for receiving and releasably retaining the looped bottom end of a blind cord, i.e. the cord 5 or the chain 6. A pair of holes 27 (FIGS. 2 and 3) are provided near the top end of the housing 10 for receiving pins 28, which act as stops for preventing removal of the counterweight 22 from the housing following installation of the protector.

The cord security device is installed by mounting the housing 10 on a wall or other structure at one end of a blind assembly with the bottom of the housing a short distance above the floor. A counterweight 22 is placed on the looped bottom or free end of each of the cord 5 and the chain 6, and the counterweight is inserted into the open top end of the housing 10. Finally, the pin 28 is placed in the hole 27 to limit upward movement of the counterweight 22, i.e. removal of the counterweight from the housing 10.

I claim:

1. A blind cord security device comprising:

a) an elongated housing vertically mountable at one end of a blind assembly;

b) a pair of parallel passages extending longitudinally of the housing for receiving a looped bottom end of a respective blind cord;

c) a respective counterweight slidably disposed in each passage for mounting on the looped bottom end of the respective blind cord and for maintaining the cord under tension; and d) a stop element for preventing unauthorized removal of the bottom end of the cord and the counterweight from the respective passage.

2. A blind cord security device according to claim 1, wherein the housing is substantially rectangular in cross section, and each passage is substantially rectangular in cross section.

3. A blind cord security device according to claim 1, wherein each counterweight includes a body slidable in the respective passage; and a groove disposed in the body for receiving and releasably retaining the looped bottom end of a blind cord.

4. A blind cord security device according to claim 3, wherein the counterweight includes a weight suspended from the body, the weight being slidable in the respective passage.

5. A blind cord security device according to claim 4, wherein the housing includes a flange portion extending outwardly from a side thereof for mounting the cord security device on a wall or other structure proximal an end of a blind assembly.

* * * * *